United States Patent [19]

Beardmore et al.

[11] Patent Number: 4,852,527

[45] Date of Patent: Aug. 1, 1989

[54] LOW NOISE VALVE TRAIN

[75] Inventors: John M. Beardmore, Howell; John A. Cafeo, Farmington, both of Mich.

[73] Assignee: General Motors Corporation, Detroit, Mich.

[21] Appl. No.: 199,219

[22] Filed: May 26, 1988

Related U.S. Application Data

[63] Continuation of Ser. No. 7,875, Jan. 28, 1987, abandoned.

[51] Int. Cl.[4] ..... F01L 1/04; F01L 1/18

[52] U.S. Cl. ..... 123/96; 123/90.46

[58] Field of Search ..... 123/90.6, 90.17, 90.16, 123/316; 74/567

[56] References Cited

U.S. PATENT DOCUMENTS

| | | | |
|---|---|---|---|
| 1,175,687 | 3/1916 | Birkigt | 123/90.6 |
| 1,254,840 | 1/1918 | Nacker | 123/90.6 |
| 2,567,689 | 9/1951 | Bishop | 123/90.6 |
| 2,567,690 | 9/1951 | Bishop et al. | 123/90.6 |
| 2,581,233 | 1/1952 | Bishop | 123/90.6 |
| 2,628,605 | 2/1953 | Jones et al. | 123/90.6 |
| 2,804,863 | 9/1957 | Bensinger et al. | 123/90.6 |
| 3,981,281 | 9/1976 | Deschler et al. | 123/90.6 |
| 4,084,568 | 4/1978 | Sato et al. | 123/90.6 |
| 4,278,233 | 7/1981 | Zurner et al. | 123/90.16 |
| 4,424,790 | 1/1984 | Curtil | 123/90.6 |
| 4,497,307 | 2/1985 | Paar et al. | 123/90.46 |
| 4,538,559 | 9/1985 | Imamura et al. | 123/90.6 |
| 4,683,848 | 8/1987 | Burandt | 123/90.6 |

FOREIGN PATENT DOCUMENTS

| | | | |
|---|---|---|---|
| 2035462 | 1/1972 | Fed. Rep. of Germany | 123/90.6 |
| 201905 | 11/1984 | Japan | 123/90.6 |
| 1070326 | 1/1984 | U.S.S.R. | 123/90.6 |

OTHER PUBLICATIONS

M. F. Spotts, "Design of Machine Elements", at 561–2 (Fifth Edition, 1–1978).

*Primary Examiner*—Willis R. Wolfe
*Assistant Examiner*—M. Macy
*Attorney, Agent, or Firm*—Robert J. Outland

[57] ABSTRACT

A low noise valve train for actuating poppet valves in an internal combustion engines includes a camshaft cam profile including a preopening bluff ramp to compress the valve train prior to opening each valve with its opening ramp and a post closing bluff ramp to quickly release compression of the valve train after closing of each valve with its closing ramp together with opening and closing ramps yielding low velocity opening and closing of the valves. The result is a combination of valve train pre and post compression to obtain low opening and closing velocities for the valves while avoiding extended operation with the valve train compressed by the action of the associated bluff ramps.

6 Claims, 4 Drawing Sheets

LOW NOISE VALVE TRAIN

CROSS REFERENCE

This is a continuation of abandoned patent application Ser. No. 007,875 filed Jan. 28, 1987 now abandoned.

TECHNICAL FIELD

This invention relates to valve trains for actuating the poppet valves of internal combustion engines and the like and, more particularly, to low noise valve trains having compressible components.

BACKGROUND

The valve train of an internal combustion engine has often been identified as a primary source of noise which can represent a significant part of the overall noise generated by the engine. As a rule, cam-in-block (CIB), push rod actuated, valve trains are more noisy than well designed overhead cam (OHC) valve trains. This difference in noise levels between CIB and OHC valve trains is commonly attributed to differences in stiffness, since the stiffer valve train is generally found to be quieter and CIB designs are usually more compressible and thus less stiff than OHC in valve trains.

Through various tests, we have learned that stiffer valve trains will generate less noise not, as has been believed, because of fewer "no follow" noise events related to the closing of clearances but because the valves will open at lower rates of acceleration and close at lower velocities. This action is related not only to the system stiffness but also to the friction level of the valve train. High friction of the connecting elements between each cam follower and the associated valve will retard the valve opening, leading to harsher opening accelerations which may introduce vibrations that can contribute to higher closing velocities and noise.

Valve opening is further delayed by compressibility of the valve train linkage through deflections of the camshaft, valve lifter, pushrod, rocker arm stud and spring retainer. These, collectively, contribute lost motion to the valve actuation. This is because the valve does not open until the net force developed by the valve train system overcomes the effect of valve spring preload and the friction above the valve lifter (primarily rocker arm friction). The point at which the valve opens is, therefore, nearly independent of speed. In like manner, the valve closing point occurs at a cam lift which is related to the system stiffness, hysteresis and associated closing loads.

In a particular test of an automotive CIB engine with pushrod and rocker arm actuation, it was found that valve opening was delayed until the corresponding cam lift had reached a value of 0.0030 to 0.0035 inches with a corresponding rocker arm stud load of 180–200 lbs. At this point the cam acceleration was very high, approaching the maximum cam acceleration rate, so that a very harsh opening of the valve resulted. This excited a system resonance which, at higher speeds, continued through the valve cycle, due to low internal damping, and contributed to higher valve closing velocities.

At lower speeds, below 3,000 rpm, friction existing in the rocker arm pivot caused another shock load to the system, producing a resonant oscillation which continued until valve closing. Thus, the valve closing was very impulsive and consistently occurred at a cam lift of about 0.0040 to 0.0045 inches where the cam velocity remained quite high.

It is the valve closing event that is usually heard as valve train noise, but the opening of the valve and the friction reversal at maximum lift play a large role in determining how hard the valve impacts it's seat. The cam velocity at the closing point is, however, a major factor in controlling the impact energy and, hence, noise generation.

As has been previously mentioned, an OHC valve train is generally quieter than a CIB valve train because, as a rule, the system stiffness is higher and the friction level is lower. Similarly, the system vibration response in an OHC engine is generally higher in frequency and lower in amplitude. Thus, in a well designed OHC valve train, the opening and closing events are easier to define, due to lower system deflections, and the OHC cam designer may not need to account for the system's lost motion. In contrast, the CIB engine designer should account for the system's lower stiffness and higher friction which are easily determined through measurements. However, while many CIB cam profiles incorporate so called opening and closing ramps, these are not generally designed with the system deflection in mind.

SUMMARY OF THE INVENTION

The present invention provides a low noise valve train having a unique camshaft profile with opening and closing ramps specifically designed to account for valve train deflection while avoiding the introduction of excessive friction loss. In general, the cam profile includes bluff shaped preopening and post closing ramps which respectively provide for rapid compression and relaxation of the valve train. These bluff ramps respectively lead to and continue from valve opening and closing ramps designed respectively for a low constant velocity of valve opening with zero cam acceleration and a very low velocity of valve closing with low-zero cam acceleration. The cam lift required for the bluff preopening and post closing ramps must be determined for each engine by actual measurement or accurate calculation of the valve train compressibility.

When properly designed, the preopening ramp quickly compresses the valve train without moving the valve, after which the opening ramp slowly lifts the valve off of it's seat. The cam then accelerates the rate of valve opening to a maximum and continues the valve motion through a normal opening and closing curve. The valve closing ramp then seats the valve smoothly at the slowest practical velocity and, subsequently, the post closing bluff ramp quickly relaxes the compression on the valve train to minimize friction during the valve closed portions of the valve cycle.

These and other features and advantages of the invention will be more fully understood from the accompanying drawings taken together with the following description of a specific embodiment of the invention chosen for purposes of illustration.

BRIEF DRAWING DESCRIPTION

Figure 4A:
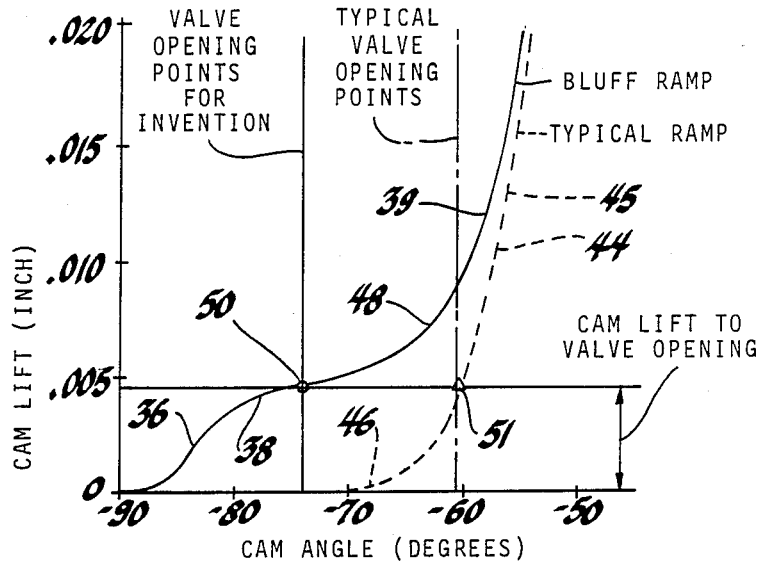
Figure 4B:
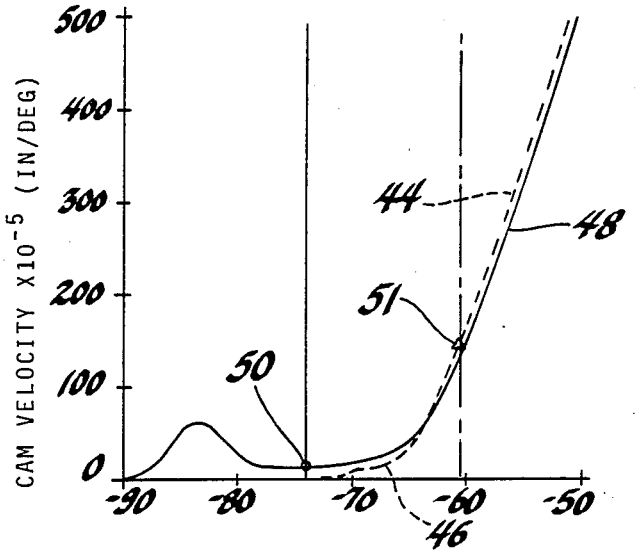
Figure 4C:
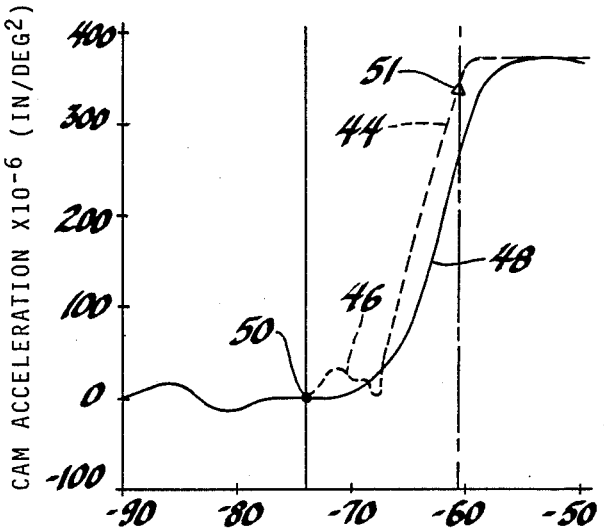
Figure 5A:
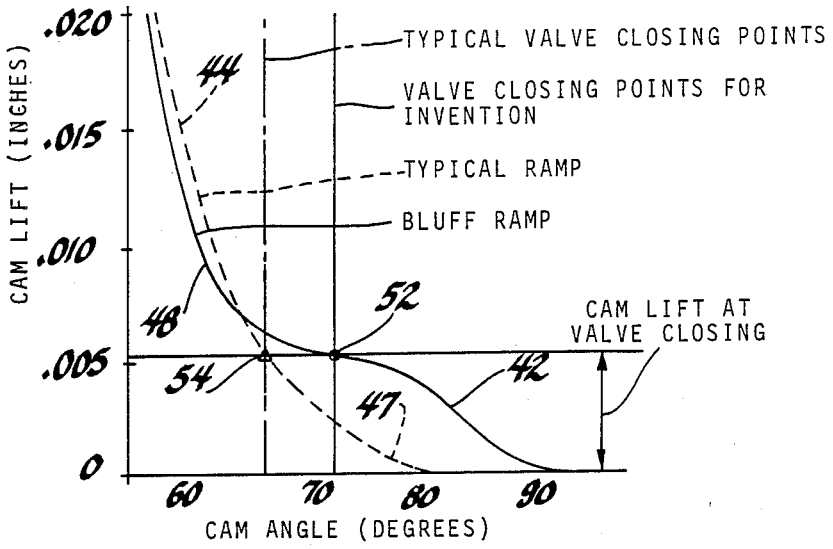
Figure 5B:
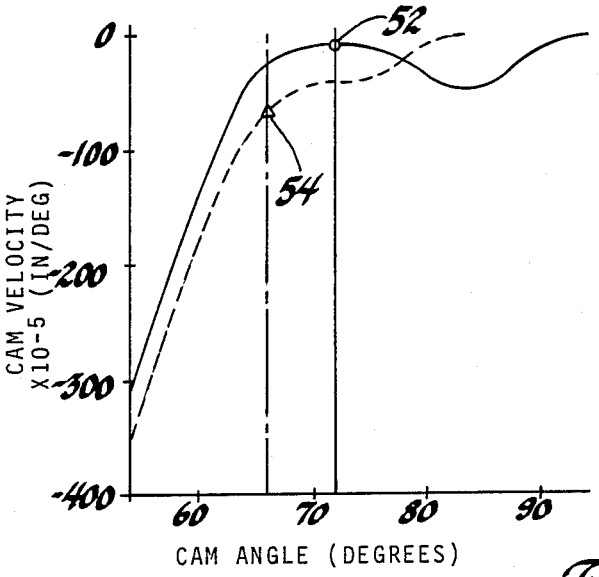
Figure 5C:
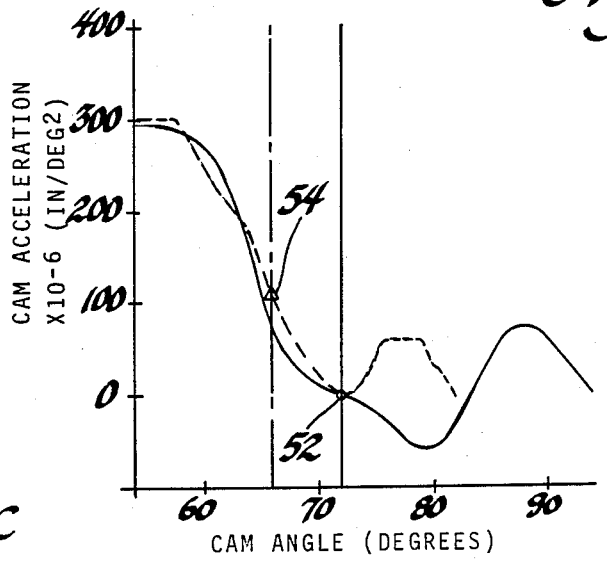

FIGS. 4*a*, 4*b*, and 4*c* are, respectively, graphs comparing the cam opening lift, velocity and acceleration for a conventional cam profile with that of the present invention, and;

FIGS. 5*a*, 5*b* and 5*c* are, respectively, graphs illustrating the cam closing lift, velocity and acceleration for a conventional cam profile as compared to that of the present invention.

DETAILED DESCRIPTION

Figure 1:
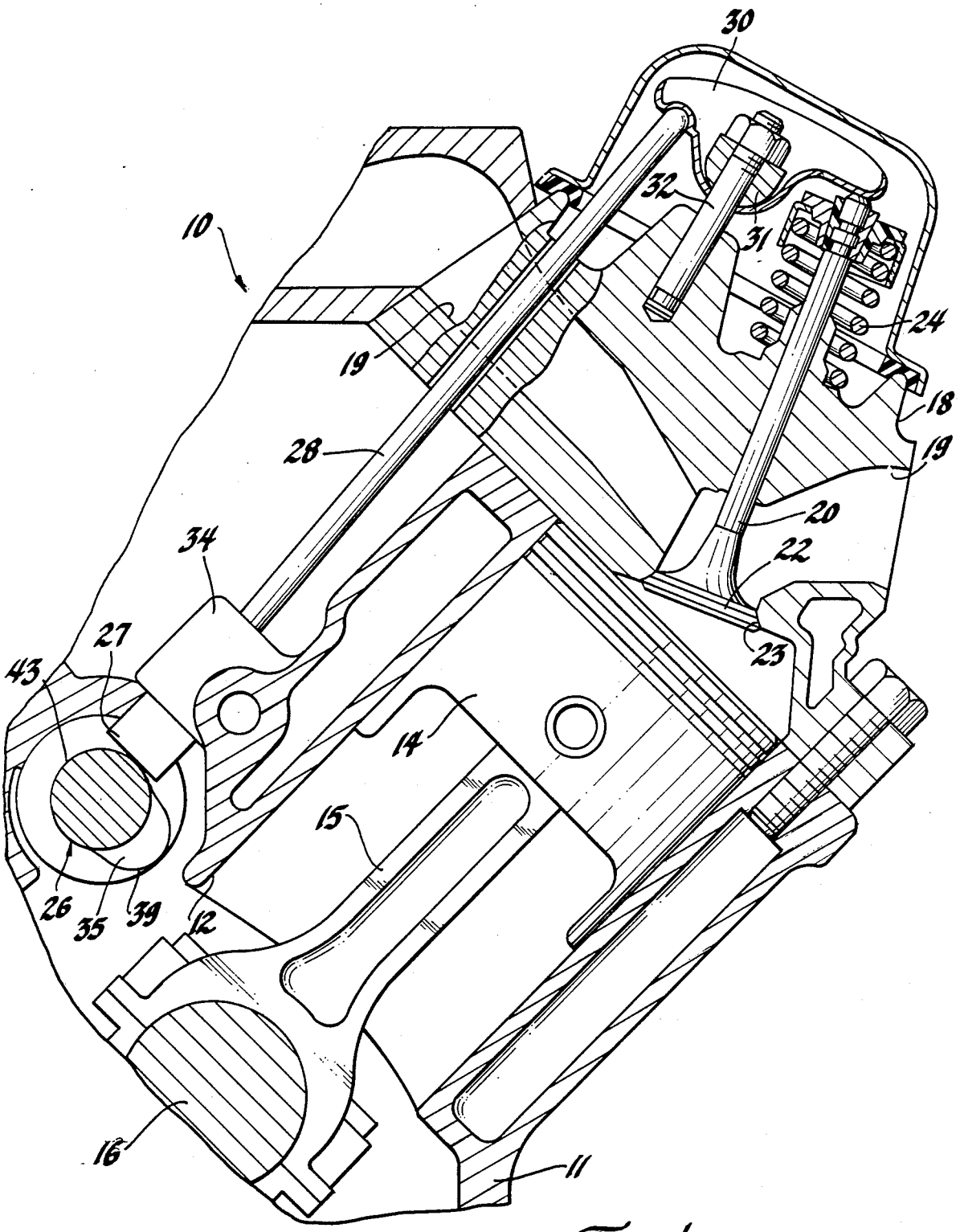
FIG. 1 is a fragmentary cross-sectional view of a V-type internal combustion engine of CIB construction having a pushrod and rocker arm type valve train driven by a camshaft formed in accordance with the invention.

Referring first to FIG. 1 of the drawings, numeral 10 generally indicates a V-type internal combustion engine having usual cylinder block 11 including two cylinder banks only one of which is fully shown. Each bank includes a plurality of cylinders 12 each having therein a reciprocable piston 14 connected by a connecting rod 15 with a crankshaft 16 rotatably supported in conventional manner in the cylinder block 11.

A cylinder head 18 is carried on the cylinder block and includes a plurality of intake and exhaust ports 19 controlled by poppet valves 20 each having a head 22. The valves are reciprocable in the cylinder head to open and closed positions, the latter being illustrated. In the closed position, the valve head 22 seats upon a valve seat 23 surrounding the port 19 in the cylinder head 18 at an inner edge where the port opens to the interior of its cylinder 12.

Each valve is urged into it's closed position by a valve spring 24 and is openable through the periodic action of a valve train including a camshaft 26, cam follower and valve lifter 27, push rod 28 and rocker arm 30. The rocker arm engages the end of the valve and the push rod and rocks on a pivot 31 carried by a ball stud 32 fixed in the cylinder head. The push rod extends between the rocker arm and the valve lifter, which is preferably of the usual hydraulic lash adjusting type and is reciprocable in an opening of a lifter gallery 34.

The camshaft 16 includes a plurality of cams 35 one of which engages each valve lifter for the purpose of actuating the valve train upon rotation of the camshaft. The camshaft is rotatably supported in the cylinder block adjacent and between the two banks of cylinders 12 near their lower ends, the construction being commonly referred to as a cam-in-block or CIB engine.

In operation, the camshaft 26 is conventionally driven by the crankshaft in predetermined phase relation therewith at a rotational speed proportional to the crankshaft speed. In each cycle, the cam 35 engages it's cam follower, or valve lifter 27, actuating the valve train so as to pivot the rocker arm, first in a opening direction to open the valve and, subsequently, in a closing direction to close the valve, all in accordance with conventional practice.

Figure 2:
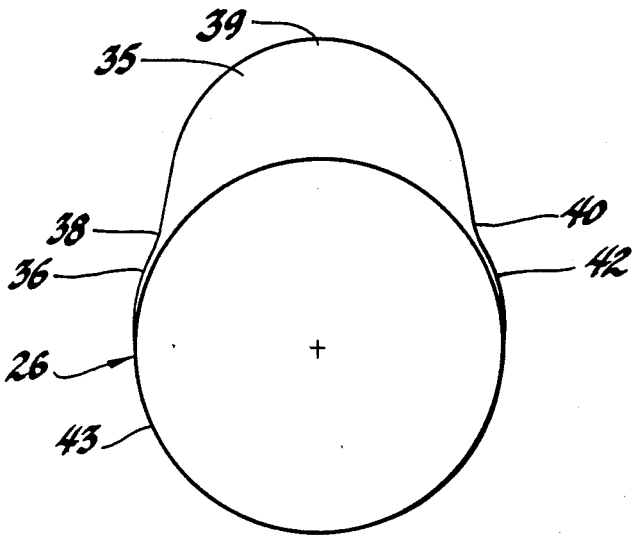
FIG. 2 is an enlarged cross-sectional view of a cam from the camshaft of FIG. 1 showing the unique cam profile and ramp configurations.

FIG. 2 shows an enlarged cross-sectional view of the camshaft 26 with one of the cams 35 which incorporate a unique cam profile according to the invention. The cam includes a preopening bluff ramp 36, a constant cam velocity opening ramp 38, a conventional valve lift curve 39 of lift dwell and fall, a very low velocity closing ramp 40 and a post closing bluff ramp 42. This differs from a conventional cam configuration in the addition of the bluff ramps for preopening and post closing to which the opening and closing ramps are connected instead of extending directly from the cam base circle 43 in which actuating forces are removed from the valve train.

For proper operation in accordance with the invention, the height or lift of the bluff opening and closing ramps must be selected, or determined, specifically for each particular valve train and engine combination so as to provide for the actual compression of the valve train linkage prior to opening and its relaxation after closing of the valve. Thus, the preopening bluff ramp 36 is dimensioned to quickly compress the valve train to a level of force immediately below that required to open the valve, after which the slow opening ramp 38 initiates valve opening. In like manner, the post closing bluff ramp 42 is dimensioned to quickly unload the compression force from the valve train after the valve has been slowly seated by the closing ramp 40.

Thus, in operation of an engine according to the invention, rotation of the camshaft with the cam follower or lifter 27 on the base circle 43 proceeds with the valve train unloaded for low friction operation until the portion of the cycle for opening of the valve is reached. At this point, the cam follower is first engaged by the bluff ramp 36 which quickly lifts the follower to compress the valve train to the load required to match the spring force urging the valve closed and the friction inherent in the valve train so that the valve is near the point of opening. The lifter is then advanced slowly by the opening ramp 38 to obtain a soft, or very low velocity, initial cam opening.

After the initial opening in which the valve is unseated, the valve motion is accelerated along the lift curve 39 to fully open the valve. Thereafter it may be held open for a prescribed rotational motion and is then moved quickly in a closing direction toward the closing ramp 40.

When the valve is nearly seated, its movement is decelerated to a very low velocity by the closing ramp 40, which lowers the valve slowly upon its seat to minimize the shock load and noise resulting therefrom. Thereafter, when the valve is seated, the post closing bluff ramp 42 quickly lowers the cam follower 27 to the base circle 43, removing the compression from the valve train and allowing continued operation at a minimum friction condition.

Figure 3:
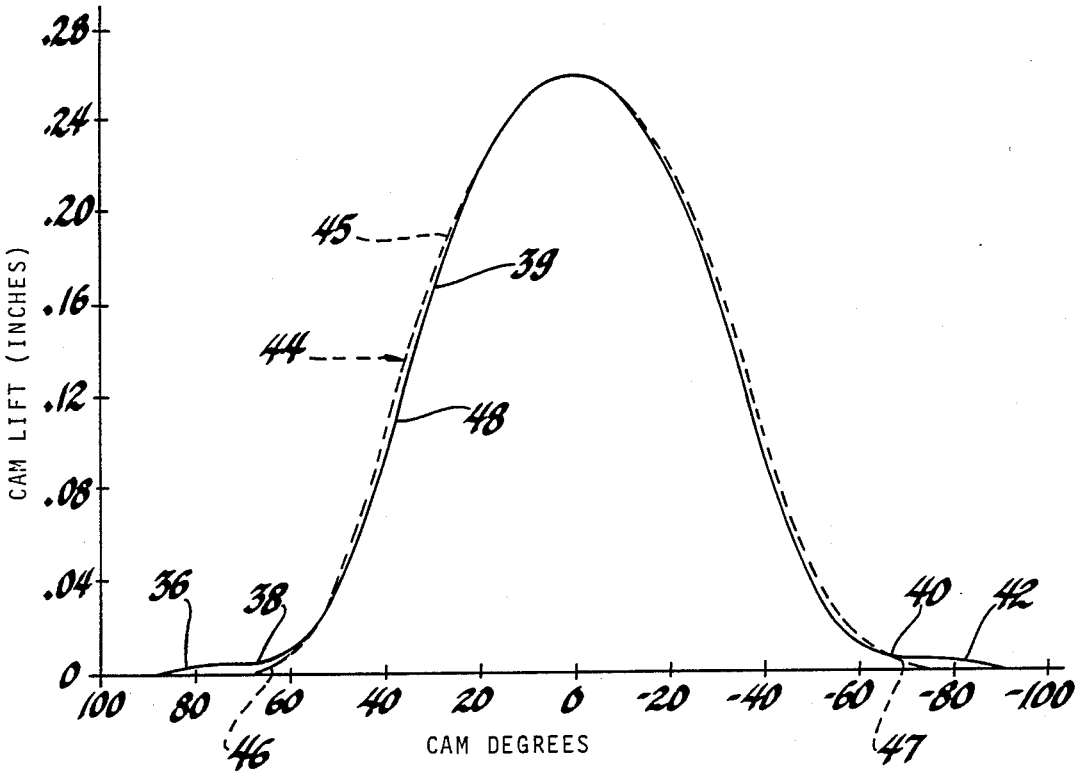
FIG. 3 is a graphical illustration of cam lift versus cam angle for a conventional cam profile compared to the profile proposed for the present invention.

FIG. 3 graphically compares the cam angle versus lift characteristics for a conventional cam with those for a cam in accordance with the invention. A dashed line 44 represents the conventional cam having a valve lift curve 45 connecting with conventional opening and closing ramps 46, and 47 respectively. A solid line 48 represents the lift curve of a cam according to the invention including in addition to the valve lift curve 39 and opening and closing ramps 38, 40, the added preopening ramp 36 and post closing ramp 42.

FIGS. 4*a*, 4*b*, and 4*c* compare the opening portions of the curves for cam lift, velocity and acceleration for the present invention with those of the conventional system. It is seen that for the present invention, represented by the solid lines 48, the fast cam rise of the preopening bluff ramp 36 is slowed by the opening ramp 38 near the valve opening point 50, reached when the valve train is fully compressed, so that the cam lift at valve opening is very slow, the cam velocity is preferably constant or nearly so and the cam acceleration is at or near zero. Acceleration along the valve lift curve 39 follows closely after the initial valve opening.

Comparatively, for the conventional cam illustrated by the dashed lines 44, the valve train is not fully compressed until after the cam opening ramp 46 so that at the conventional valve opening point 51, the rate of valve lift, as shown by the slope of the valve lift curve 45 and the height of the velocity curve, is very high and the cam acceleration is also high leading to a harsh valve opening with the results previously indicated.

Similarly, FIGS. 5*a*, 5*b* and 5*c* compare the closing portions of the cam lift, velocity and acceleration curves for a conventional system shown by dashed line 44 and the present invention shown by solid line 48. With the system of the present invention, the cam velocity at the valve closing point 52 is preferably zero or at least very low, after which the compression of the valve train is quickly released by the rapidly descending post closing bluff ramp 42. In comparison, the valve closing point 54 for the conventional system occurs before reaching the closing ramp 47 of the cam. Thus, the cam velocity and acceleration are still quite high, leading to a hard seating of the valve on its seat and the creation of noise as previously discussed.

As the foregoing discussion and associated figures illustrate, the present invention improves the operation of compressible valve trains for internal combustion engines by providing fast rising bluff opening ramps and fast falling bluff closing ramps to account for taking up and releasing compression of the compressible valve trains prior to initiating action of the opening ramp and after the action of the closing ramp in respectively opening and closing the valves. The result is to open and close the valves at very slow rates while applying and releasing compression of the valve trains at very fast rates so as to minimize operation at high friction levels. The resulting form of cam lift curve can be adapted, by suitable selection of the bluff ramp heights, to any desired valve train whether of the cam-in-block (CIB) or overhead cam (OHC) type and having either hydraulic or mechanical lash adjusters. The selection of the bluff ramp heights must accommodate the actual compression in the valve train in which it is adapted. Obviously, the noise reduction resulting from the application of this invention to a very stiff overhead cam valve train will be less than when applied to a more compressible CIB design. However, some improvement may still be provided since, to some extent, all valve trains are compressible.

While the invention has been described by reference to a selected embodiment, it should be understood that numerous changes could be made within the spirit and scope of the inventive concepts described. Accordingly it is intended that the invention not be limited to the described embodiment, but that it have the full scope permitted by the language of the following claims.

We claim:

1. Low noise valve train for an internal combustion engine, said valve train comprising a poppet valve reciprocably movable to open and closed positions by opening and closing motions respectively including lifting from and seating upon a valve seat, a valve spring urging the valve toward its closed position with a predetermined seating force, a rotatable member having a cam for causing and controlling the opening and closing motions of the valve against the force of the valve spring, a hydraulic lash adjuster and mechanical connecting means acting between the cam and the valve to transmit the rise and fall of the cam at least partially to the valve to cause opening and closing motions thereof, said mechanical connecting means having stiffness characteristics that require a determinable cam rise to compress the mechanical connecting means from an unloaded condition to a load adequate to open the valve and a determinable cam fall to unload the mechanical connecting means after seating of the valve, said cam having a profile operatively related to the stiffness of said mechanical connecting means and including, in the sequence of rotation, a bluff opening ramp of variable slope operative to compress the mechanical connecting means to near the point of valve opening, an unseating portion operative during unseating of the valve and of shallow slope significantly lower than the maximum slope of the bluff ramp resulting in a low valve velocity during said unseating thereof, a valve lift curve of any desired configuration, a seating portion operative during seating of the valve and of shallow negative slope resulting in a low valve velocity during said seating thereof, and a bluff closing ramp of variable slope with a maximum significantly more negative than the slope of the closing ramp to rapidly unload the mechanical connecting means after closing of the valve.

2. Low noise value train as in claim 1 wherein said unseating portion of the cam profile has an essentially constant slope.

3. Low noise valve train for an internal combustion engine, said valve train comprising poppet valves reciprocably movable to open and closed positions by opening and closing motions respectively including lifting from and seating upon valve seats, valve springs urging the valves toward their closed positions with predetermined seating forces, a camshaft having a plurality of cams for causing and controlling the opening and closing motions of the valves against the force of the valve springs, a hydraulic lash adjuster and mechanical connecting means acting between each cam and its respective valve to transmit the rise and fall of each cam at least partially to its valve to cause opening and closing motions thereof, said mechanical connecting means having stiffness characteristics that require a determinable cam rise to compress each mechanical connecting means from an unloaded condition to a load adequate to open its valve and a determinable cam fall to unload the mechanical connecting means after seating of the valve, each said cam having a profile operatively related to the stiffness of said mechanical connecting means and including, in the sequence of rotation, a bluff opening ramp of variable slope operative to compress the mechanical connecting means to near the point of valve opening, an unseating portion operative during unseating of the valve and of shallow slope significantly lower than the maximum slope of the bluff ramp resulting in a low valve velocity during said unseating thereof, a valve lift curve of any desired configuration, a seating portion operative during seating of the valve and of shallow negative slope resulting in a low valve velocity during said seating thereof, and a bluff closing ramp of variable slope with a maximum significantly more negative than the slope of the closing ramp to unload the mechanical connecting means after closing of the valve.

4. Low noise valve train as in claim 3 wherein said unseating portion of each cam profile has an essentially constant slope.

5. Low noise valve train as in claim 3 wherein each hydraulic valve lifter is combined with an associated cam follower.

6. Low noise valve train as in claim 5 wherein each connecting means includes a push rod and a rocker arm acting in series.

* * * * *